US006142466A

United States Patent [19]

Dickhoff

[11] Patent Number: 6,142,466

[45] Date of Patent: Nov. 7, 2000

[54] APPARATUS FOR STACKED DEPOSITING AND ALIGNMENT OF INDIVIDUALLY DELIVERED SHEETS

[76] Inventor: Andreas Dickhoff, Kodak Aktiengesellschaft, 70323 Stuttgart, Germany

[21] Appl. No.: 09/126,305

[22] Filed: Jul. 30, 1998

[30] Foreign Application Priority Data

Aug. 2, 1997 [DE] Germany ..... 197 33 450

[51] Int. Cl.[7] ..... B65H 31/26

[52] U.S. Cl. ..... 271/220; 271/314

[58] Field of Search ..... 271/220, 207, 271/245, 314, 81; 399/405

[56] References Cited

U.S. PATENT DOCUMENTS

| | | | |
|---|---|---|---|
| 5,120,046 | 6/1992 | Mandel et al. | 271/220 |
| 5,120,047 | 6/1992 | Mandel et al. | 271/220 |
| 5,284,338 | 2/1994 | Allmendinger et al. | 271/220 |

FOREIGN PATENT DOCUMENTS

| | | | |
|---|---|---|---|
| 0 501 626 A1 | 9/1992 | European Pat. Off. | B65H 29/22 |
| 0 501 627 A1 | 9/1992 | European Pat. Off. | B65H 29/22 |
| 42 07 070 C2 | 9/1996 | Germany | B65H 31/36 |
| 0159298 | 12/1979 | Japan | 271/314 |
| 403267265 | 11/1991 | Japan | 271/220 |

*Primary Examiner*—H. Grant Skaggs
*Attorney, Agent, or Firm*—Lawrence R. Kessler

[57] ABSTRACT

The invention relates to an apparatus having means for delivering, depositing, and aligning individual sheets (S) in a collecting tray (7) to form at least one sheet stack (8) from sheets collected one on top of another, the collecting tray of which has a depositing surface (70) with at least one front delimiter (71) against which the sheets are aligned, and having a holddown element (3) resting on the sheet stack, wherein the alignment means (1) for aligning a topmost delivered sheet (S) are drivable by a drive unit (6) and the alignment means are movable together with the holddown element relative to the stack in the stacking direction. To create an apparatus which prevents high wear on the alignment rollers and high loading of the topmost sheet of a sheet stack while at the same time reliably aligning the sheets delivered onto the stack and, in addition, securely holding the sheet stack in the collecting tray, a radial cam (2) is provided for the alignment means (1), which cam is supported on the holddown element (3) and by which the alignment means (1) can on the one hand be brought out of engagement with the topmost sheet of the stack during delivery of a sheet (S) to the stack (8), and can on the other hand be brought into engagement therewith in order to align the delivered sheet (S).

13 Claims, 4 Drawing Sheets

APPARATUS FOR STACKED DEPOSITING AND ALIGNMENT OF INDIVIDUALLY DELIVERED SHEETS

FIELD OF THE INVENTION

The invention relates to an apparatus having means for delivering, depositing, and aligning individual sheets in a collecting tray to form at least one sheet stack from sheets collected one on top of another, the collecting tray of which has a depositing surface with at least one front delimiter against which the sheets are aligned, and having a holddown element, resting on the stack, for the sheets of the stack, the alignment means for aligning a topmost delivered sheet being drivable by a drive unit and the alignment means being movable together with the holddown element relative to the stack in the stacking direction.

BACKGROUND OF THE INVENTION

European Patent Applications 0 501 626 and 0 501 627 disclose an apparatus of the generic type, having means for delivering, depositing, aligning, and holding down individual sheets in a collecting tray to form a sheet stack from sheets collected one on top of another, in which the alignment means are continuously in engagement with the topmost sheet of the stack during sheet delivery. This leads on the one hand to increased wear on a rotating alignment roller provided in the alignment means, and on the other hand can result in high loading of the topmost sheet, such as curling, creasing, or lifting of the sheet at the delimiters.

These disadvantages cannot be entirely eliminated either by the reduction made in the contact force of the alignment roller and of the holddown element, or by the specific physical configuration of the holddown element. In addition, the low contact force of the alignment roller and of the holddown element results in unreliable edge alignment and flatness of the topmost sheet. Moreover, it is not possible for sheets to be properly delivered, stacked, and aligned in a collecting tray having a depositing surface which rises in the delivery direction, since transport and positioning of the sheets cannot be guaranteed by the reduced friction of the alignment roller and the low holding force of the holddown element.

The reduction in contact force is accomplished, in this context, by slaving the alignment roller and holddown element as a function of the stack height by means of a motor-driven drive unit and an additional linear stroke spring device.

German Patent No. 42 07 070 discloses an apparatus having means for delivering, depositing, and aligning individual sheets in a collecting tray to form a sheet stack from sheets collected on top of one another, in which the alignment means are lifted while the topmost sheet of the stack is being delivered, and is only then lowered for alignment onto the topmost delivered sheet of the stack.

In this aforesaid apparatus, the alignment means are lowered by means of a controlled linear stroke electromagnet from the upper initial position, sensed by a sensor, in which a completed sheet stack can be removed, into the lower end position or onto the stack. In addition, two rotating alignment rollers of the alignment means are driven by means of a motor-driven drive unit.

It is disadvantageous that on the one hand, the sheet stack is not securely held by means of a holddown element before and during sheet delivery, so that for the purpose of reliable operation (as disclosed), only one collecting tray with a depositing surface sloping down in the delivery direction, and with a front delimiter attached at the lower end, can be used; and on the other hand that an additional drive unit for the alignment rollers is required.

It is therefore the object of the invention to create an apparatus of the generic type which on the one hand prevents high wear on the alignment rollers and high loading of the topmost sheet of a sheet stack, while at the same time reliably aligning the sheets delivered onto the stack and, in addition, securely holding the sheet stack in the collecting tray, and which on the other hand allows easy removal of a completed sheet stack from the collecting tray, and has a simple and compact design, this guaranteeing functionality in an automatic environment.

SUMMARY OF THE INVENTION

According to the invention, this object is achieved by an apparatus for sheet alignment including a radial cam which is supported on a holddown element and by which the apparatus can on the one hand be brought out of engagement with the topmost sheet of the stack during delivery of a sheet to the stack, and on the other hand can be brought into engagement therewith in order to align the delivered sheet.

Advantageously, shortly before the topmost delivered sheet reaches the front delimiter of the collecting tray and shortly before the topmost delivered sheet is released by delivery rollers of the apparatus, the alignment apparatus can be brought into engagement with the topmost delivered sheet by the radial cam, and out of engagement with the topmost delivered sheet when the topmost sheet has reached the front delimiter of the collecting tray, such that before the alignment apparatus are brought into engagement with the topmost sheet delivered onto the stack, the latter can be brought by means of the drive unit up to an alignment speed in the sheet alignment direction which corresponds to the speed of the sheet in the delivery direction shortly before reaching the front delimiter of the collecting tray.

Advantageously, the alignment apparatus have at least one alignment roller which is rotatable about their rotation axis and has on the outer periphery a concentrically arranged D-shaped alignment segment with a friction surface applied on its outer periphery. In addition, the radial cam, configured as a cam plate with a cam lobe, is arranged on the rotation axis of the alignment roller, the holddown element is pivotable in the stacking direction and defines a sheet thread-in guide, and the radial cam is not supported with the cam lobe on the holddown element when the alignment roller is in engagement on the topmost sheet.

Moreover, the object is advantageously achieved by a lifting device for the alignment apparatus by which the holddown element can together be brought into a position spaced away from the topmost sheet of the stack for removal of a completed sheet stack from the collecting tray.

Advantageously, the alignment apparatus and the radial cam can together be driven by a single drive unit rotating along in the sheet alignment direction, and the alignment apparatus and the holddown element can additionally be brought into the removal position by the single drive unit such that in order to bring the holddown element and the alignment apparatus, controlled by a radial cam, into the removal position, the drive unit can be operated in a drive direction opposite to the sheet delivery direction and sheet alignment direction.

BRIEF DESCRIPTION OF THE DRAWINGS

Further features and advantages can be inferred from the description of embodiments of the invention illustrated in the drawings in which FIG. 1 the apparatus according to the invention in a perspective depiction, viewed from the left, without the connection to mounts and sheet delivery devices provided on the apparatus.

DETAILED DESCRIPTION OF THE INVENTION

Figure 1:
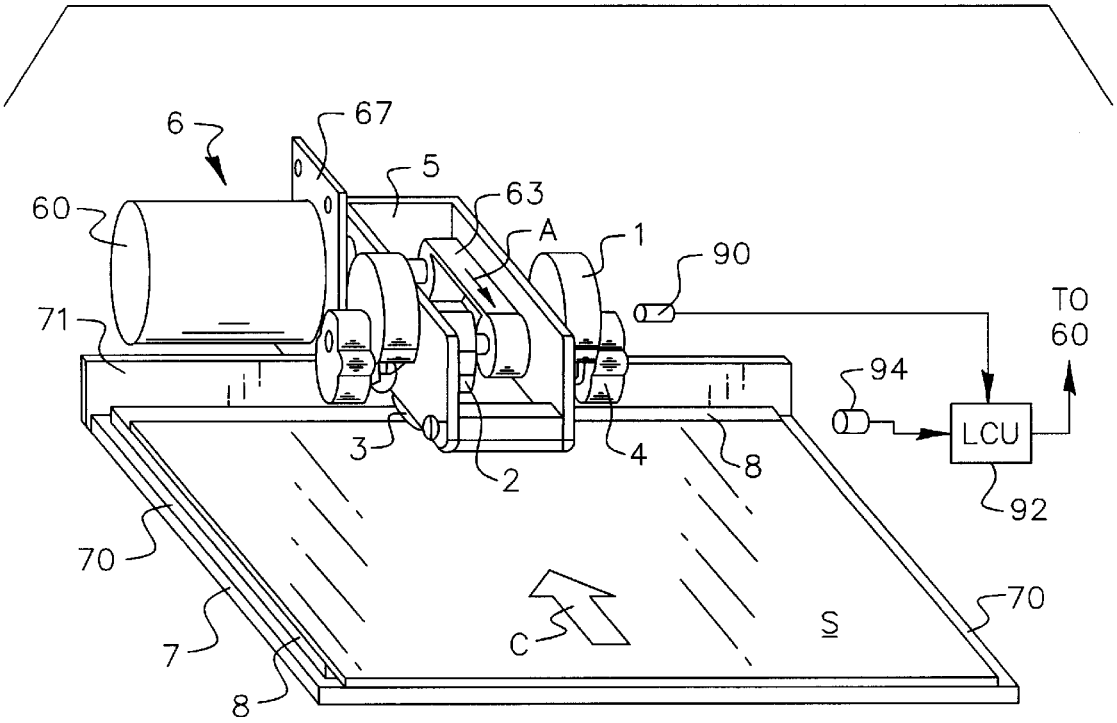

The description below regarding FIGS. 1 to 7 refers to a preferred embodiment of the apparatus according to the invention for delivering, depositing, and aligning individual sheets S in a collecting tray 7 to form at least one sheet stack 8 of sheets collected on top of one another, the collecting tray of which has a depositing surface 70 with at least one front delimiter 71 against which the sheets are aligned, and having a holddown element 3 resting on the sheet stack such that alignment apparatus 1 for aligning a topmost delivered sheet S can be driven by means of a drive unit 6, and the alignment apparatus can be moved together with the holddown element in the stacking direction relative to the stack. In this context, the apparatus is used in a device (not depicted) of a known type, for example a copier, and preferably serves to output completed customer-specific copy jobs.

It is self-evident to one skilled in the art that the apparatus according to the invention can also be used in other devices, such as printing or sheet sorting devices, and can serve within the devices as a holding tray for sheet stacks; and that sheets of various kinds, with different thicknesses, sizes, and weights, can be used.

Figure 2:
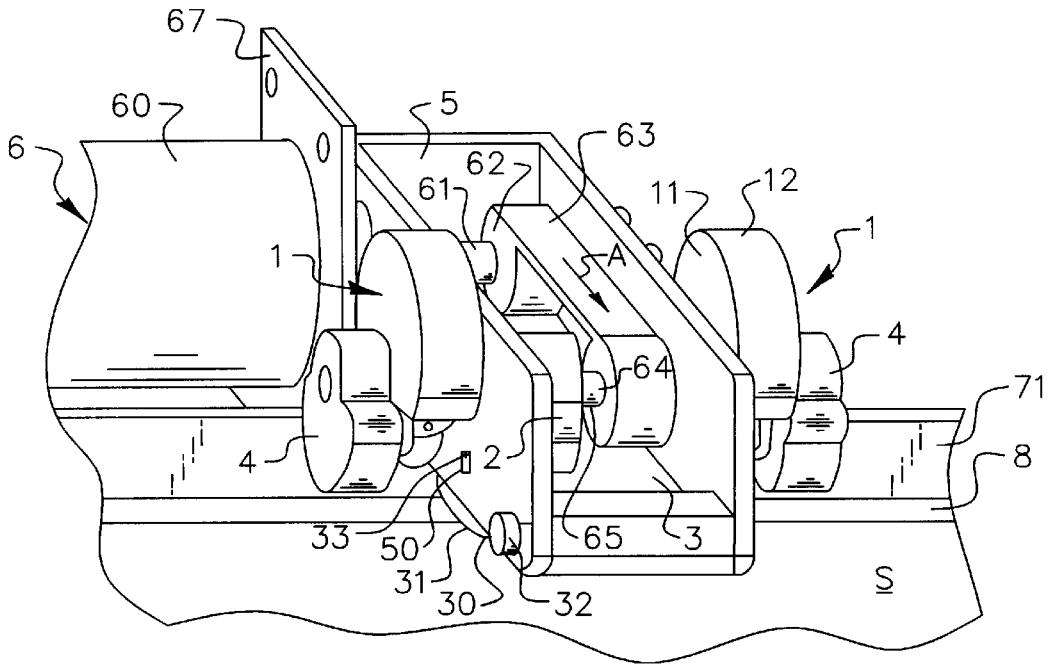
FIG. 2 the apparatus as depicted in FIG. 1, in an enlarged partial depiction of the drive unit with the radial cam, the sheet alignment means, and the sheet holddown element, in its initial position in which the sheet alignment means are out of engagement with the topmost delivered sheet of the stack.
Figure 3:
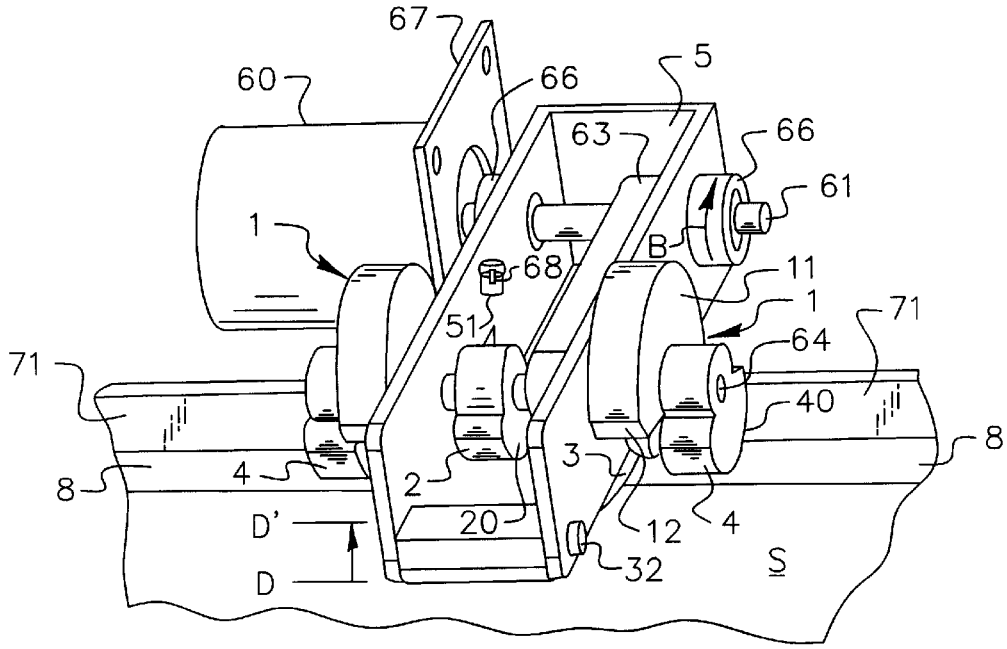
FIG. 3 the apparatus as depicted in FIG. 2, in a view from the right.

In FIG. 1, FIG. 2, and FIG. 3, the preferred apparatus according to the invention is shown in a basic operating position D in which on the one hand the alignment apparatus 1 are out of engagement with sheet stack 8 in an initial position and holddown element 3 is resting on sheet stack, and in which on the other hand a topmost sheet S, delivered to the sheet stack by delivery rollers (not shown), is in a position just before front delimiter 71 of collecting tray 7. The initial position of alignment apparatus 1 is sensed by means of a sensor 90 and established by a microprocessor-controlled control unit 92.

The apparatus advantageously has a radial cam 2 with a cam lobe 20 for alignment apparatus 1, which cam is supported on holddown element 3 and by which the alignment apparatus can be brought on the one hand out of engagement with the topmost sheet of the stack during delivery of a sheet S to stack 8, and on the other hand into engagement therewith in order to align the topmost delivered sheet S, radial cam 2 not being supported with its cam on the holddown element when alignment apparatus 1 are in engagement with the topmost sheet.

Alignment apparatus 1 have two alignment rollers—or, as in an embodiment not shown, at least one alignment roller that is rotatable about its rotation axis, which have on the outer periphery a concentrically arranged D-shaped alignment segment 11 with a friction surface 12 applied on its outer periphery. Radial cam 2 is configured as a cam plate 2 and is arranged on the rotation axis of alignment roller.

Alignment apparatus 1 or the alignment rollers, and radial cam 2 can together be driven by a single drive unit 6 which rotates in the sheet alignment direction A. For this purpose, on the one hand alignment rollers and radial cam 2 are arranged on a common holder 5 which is pivotably mounted at its first end by two bearing bushings 66 or, as in an embodiment not shown, with one bearing bushing on an input drive shaft 61 of drive unit 6, and on the other hand alignment rollers and radial cam 2 are arranged with their rotation axes on a common output shaft 64, extending parallel to input drive shaft 61, at a second end of holder 5, the output drive shaft 64 being in operative engagement with input drive shaft by means of a belt drive.

Holder 5 is configured in the shape of a horizontal U-shaped bracket, the back part of which forms the first end of the holder. Radial cam 2, holddown element 3 and the belt drive comprising an input drive belt pulley 62, an output drive belt pulley 65 and a toothed belt 63, are arranged between the limbs of the U-shaped bracket. Alignment rollers, entraining element 4 and drive unit 6 which has a microprocessor-controlled stepping motor 60 or servomotor, are arranged on either side of and outside the limbs. Stepping motor 60 is held on a support 67 and can be displaced vertically or in the stacking direction relative to collecting tray. In this context, holder 5 with alignment apparatus 1, radial cam 2 and holddown element 3, as well as drive unit 6 can be adjusted together and automatically by means of another known drive unit (not depicted) to the respective stack height of sheet stack 8, the stack height being determined by a known sheet counting device and/or stack height measurement device 94 (see FIG. 1). In a further embodiment not shown, collecting tray 7 can be displaced in accordance with the sheet stack height.

Figure 5:
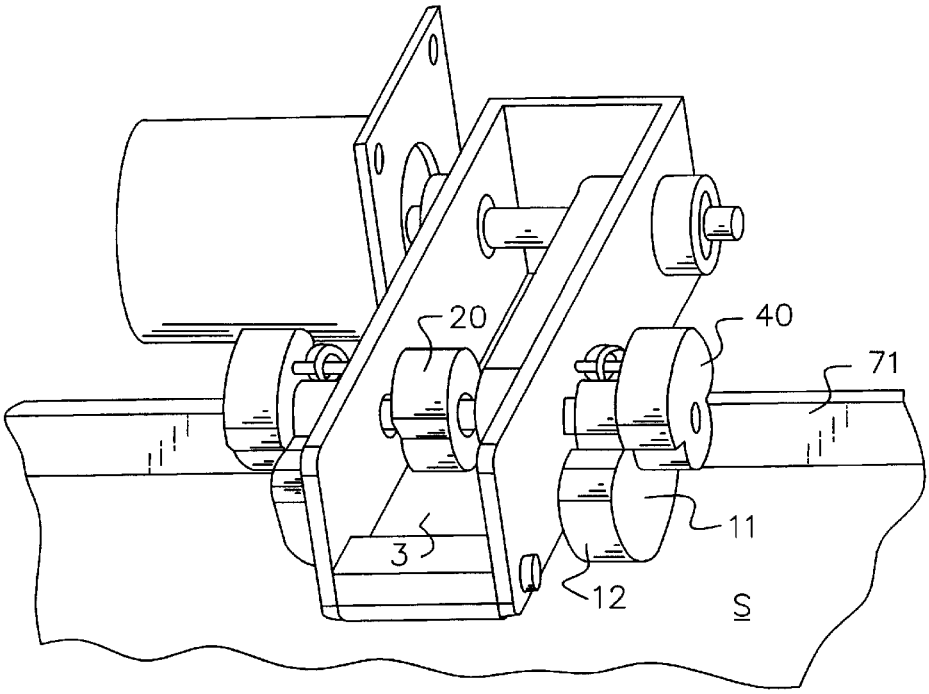
FIG. 5 the apparatus as depicted in FIGS. 2 and 3 in a second position after the initial position, in which the sheet alignment means are in engagement.
Figure 6:
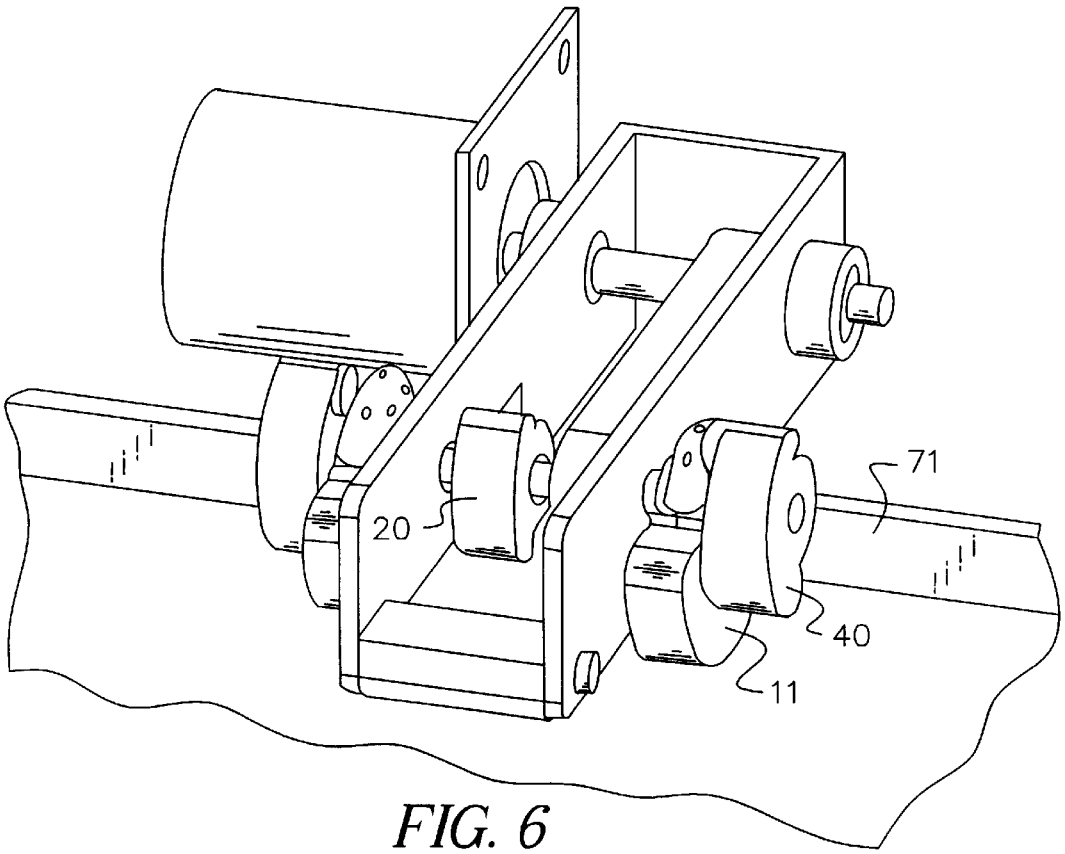
FIG. 6 the apparatus as depicted in FIGS. 2 and 3 in a third position after the initial position, in which the sheet alignment means are in an advanced engagement position.
Figure 7:
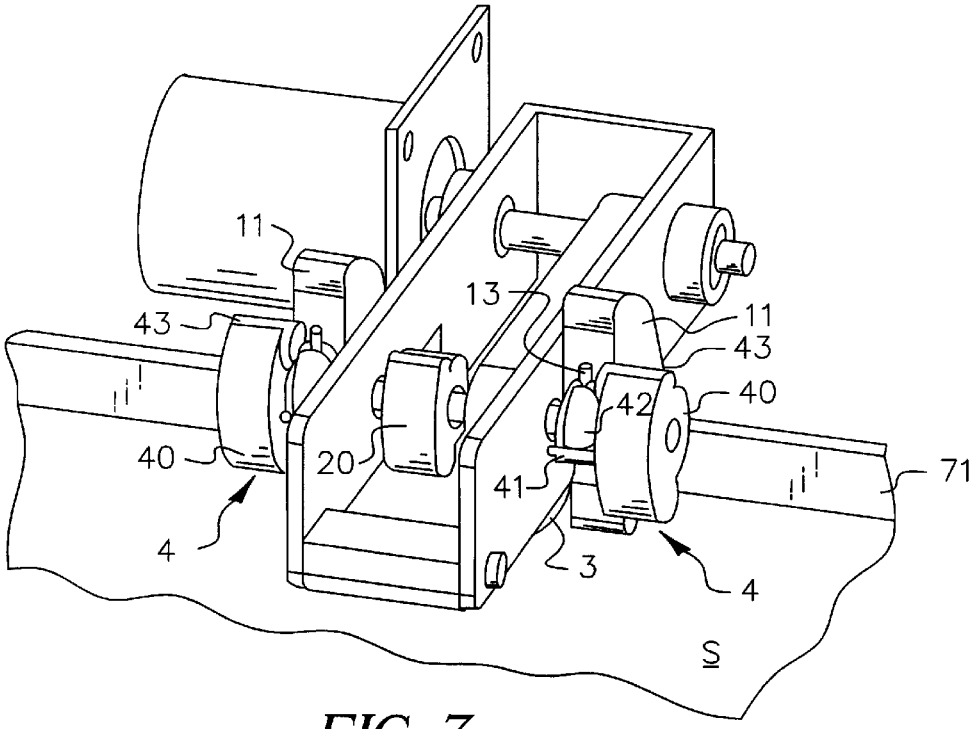
FIG. 7 the apparatus as depicted in FIGS. 2 and 3 in a fourth position after the initial position, in which the sheet alignment means are ending their engagement.

As is apparent from FIGS. 1 to 7, radial cam 2 configured as cam plate 2 is rigidly joined to output drive shaft 64, alignment rollers 1 are mounted so as to rotate freely on output drive shaft 64, and as shown in FIG. 7, alignment rollers 1 are each connected by means of a spring element 42 to entraining elements 4 joined rigidly to output drive shaft 64.

Spring element 42 configured as a helical tension spring, which is arranged concentrically with output drive shaft 64 and joined via retaining pins 13, 41 to the respective entraining element 4 or D-shaped entraining element segment 40 and to the respective alignment roller 1 or alignment segment 11, is tuned in terms of its minimum spring force in such a way that during alignment of the topmost delivered sheet S, alignment element 11 is entrained by entraining element 4 without significant extension of spring element 42 such that during alignment, a frictional force is generated on the topmost delivered sheet S by means of friction surface 12 of the alignment roller, the force being dimensioned such that a sheet S with a heavy weight and a low coefficient of friction can be reliably aligned against front delimiter 71 of collecting tray 7, and spring element 42 is also tuned in terms of its maximum spring force in such a way that a sheet with a light weight and/or low stiffness is not curled, creased, or lifted at the delimiter as it is aligned against front delimiter 71.

Holddown element 3 which is pivotable in the stacking direction and defines a sheet thread-in guide, is also arranged on holder 5. As FIGS. 1 and 2 show, holddown element 3 is mounted by means of a pivot pin 32 at the bottom of the second end of holder 5 in front of output drive shaft 64 with respect to sheet delivery direction C, and can be pivoted against a travel limiter comprising a travel limiter stud 33 on holddown element 3 and an oblong travel limiter hole 50 on holder 5. Holddown element 3 also has a funnel-shaped sheet guide portion 30 in the region of its pivot pin 32 and a holddown portion 31 in the region of front delimiter 71 of collecting tray 7.

As depicted in FIG. 3, alignment apparatus 1 and holddown element 3 can together be brought, by means of a lifting unit 6; 66, from basic operating position D into a position D' spaced away from topmost sheet S of stack 8 for removal of a completed sheet stack S from collecting tray 7. Lifting unit 6; 66 is constituted by a bearing means 66 (with freewheel and catch) which operates in response to the direction of rotation and by drive unit 6 for alignment apparatus 1.

In order to bring holddown element 3 and alignment apparatus 1, controlled by means of a radial cam 2, into the removal position, drive unit 6 can be operated by means of the control unit in a drive direction B opposite to sheet delivery direction C and sheet alignment direction A.

When input drive shaft 61 is rotating in direction A in sheet alignment direction A, C, bearing bushing 66 and thus holder 5 run freely on input drive shaft 61, while alignment rollers and radial cam 2 simultaneously rotate in the sheet alignment direction.

When input drive shaft 61 is rotating in direction B opposite to sheet alignment direction A and sheet delivery direction C, bearing bushing 66 locks on the input drive shaft and thus pivots holder 5 upward into removal position D' and against a stop comprising an oblong travel limiter hole 51 of holder 5 and a stop pin 68 of motor support 67.

The apparatus operates as follows:

Proceeding from basic operating position D of the apparatus as depicted in FIGS. 1 to 3, in which alignment rollers with their alignment elements 11 are held by means of cam lobe 20 of radial cam 2 out of engagement with sheet stack 8 and with depositing surface 70 of collecting tray 7 in an initial position above output drive shaft 64, and in which holddown element 3 (resting on the stack with its sheet holddown portion 31), rests together with the weight of holder 5, alignment apparatus 1 and radial cam 2 on the sheet stack or depositing surface, a sheet S is delivered by means of motor-driven delivery rollers (not shown) out of the apparatus to collecting tray 7 in direction C.

Once the sheet, delivered to the depositing surface or the top of the stack, has reached with its front edge the region below the funnel-shaped sheet guide portion 30 of the holddown element and that of alignment rollers, drive motor 60 of drive unit 6 is started by means of the control unit (not shown), and alignment rollers together with radial cam 2 are caused to rotate in alignment direction A by means of input drive shaft 61 and belt drive 62, 63, 64.

Shortly before friction surfaces 12 of the D-shaped alignment segments 11 are brought into engagement with the topmost sheet S delivered onto stack 8, the friction surface is accelerated by means of drive unit 6 to an alignment speed in sheet alignment direction A which corresponds to the speed of the delivered sheet S in delivery direction C shortly before reaching front delimiter 71 of collecting tray 7.

Figure 4:
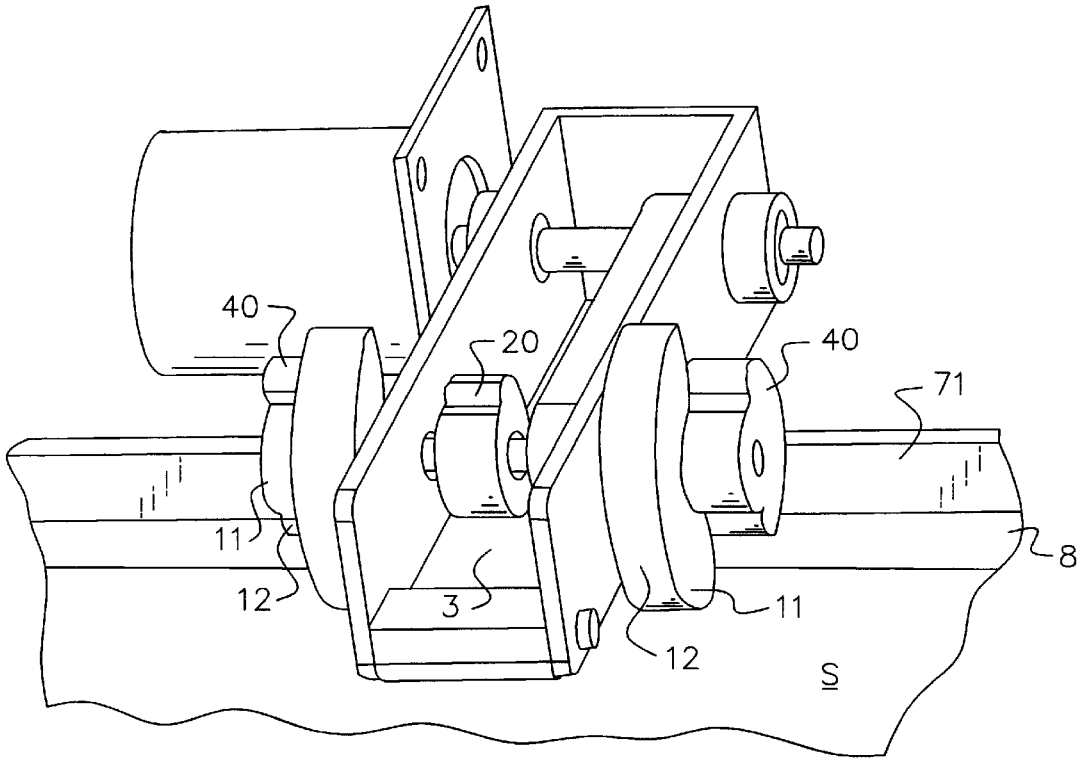
FIG. 4 the apparatus as depicted in FIGS. 2 and 3 in a first position after the initial position, in which the sheet alignment means are beginning their engagement.

Then, as shown in FIG. 4, shortly before the topmost delivered sheet S reaches front delimiter 71 and shortly before that sheet is released by the delivery rollers of the apparatus, friction surfaces 12 of alignment apparatus 1 are brought in slip-free fashion into engagement therewith by means of radial cam 2 and rotation of cam lobe 20. Further transport of the delivered sheet S is initially only assisted by alignment elements 11, and after the sheet is released by the delivery rollers is performed exclusively by them, along with alignment. In this context, alignment rollers are entrained via spring elements 42 by entraining elements 4 joined rigidly to output drive shaft 64, slightly tensioning the spring elements. During this transport and alignment phase, the vertically pivotable holddown element 3 which has a low coefficient of friction rests on the sheet only under its own weight, so that only a small deceleration force resulting from the holddown element acts on the sheet.

Once the topmost delivered sheet S has reached front delimiter 71 of collecting tray 7 as shown in FIGS. 5 and 6, alignment rollers, mounted so as to rotate freely on output drive shaft 64, are also decelerated and retained by the frictional force between friction surfaces 12 and the surface of delivered sheet S, and spring elements 42 between alignment rollers and entraining elements 4 of output drive shaft 64 are further tensioned until radial cam 2 with its cam lobe 20 just begins to support itself again on holddown element 3, and alignment rollers 1 and alignment elements 11 begin to lift off from sheet S.

As radial cam 2 is rotated further, it lifts alignment rollers 1 by means of its cam lobe 20 being supported on holddown element 3. In the process, as shown in FIG. 7, the pretensioned spring force of spring elements 42 causes alignment rollers and alignment elements 11, while they are coming out of engagement with the topmost delivered sheet, to be pulled back in alignment direction A and pivoted against an impact-damping stop on entraining element 43, and brought in combination with spring elements 42 back into their initial position shown in FIGS. 1 to 3, which is sensed by the sensor device 90.

Drive motor 60 is then shut off until a next sheet S is delivered into the above-described position by means of the delivery rollers of the apparatus.

For removal of the stack once a requested sheet stack 8 is completed, drive motor 60 is briefly activated by means of the microprocessor-controlled control unit in a rotation direction B opposite to alignment direction A, and holder 5 with the attached alignment apparatus 1, radial cam 2 and holddown element 3, coacting with the locking system of bearing bushings 66, is pivoted upward, i.e. away from the stack toward stop 68 and into removal position D'.

After sheet stack 8 has been removed, drive motor 60 is again briefly operated in alignment direction A and the apparatus is pivoted back into basic operating position D on depositing surface 70 of collecting tray 7.

The invention has been described in detail with particular reference to certain preferred embodiments thereof, but it will be understood that variations and modifications can be effected within the spirit and scope of the invention.

PARTS LIST

A Sheet alignment direction (drive unit/alignment means)
B Direction opposite to sheet alignment direction C Sheet delivery direction
D Basic operating position of holder and alignment means
D' Removal position of holder for sheet stack removal
S Sheet
1 Alignment means, D-shaped alignment roller
2 Radial cam/cam plate (for alignment roller)
3 Holddown element (for sheet stack)
4 Entraining element (for alignment roller)
5 Holder (for alignment means, radial cam, holddown element)
6 Drive unit/lifting unit (for alignment means, radial cam)
7 Collecting tray (for sheets, sheet stack)
8 Sheet stack
11 D-shaped alignment element (alignment means)
12 Friction surface (alignment element)
13 Entraining element pin (for spring element)
20 Cam lobe (radial cam/cam plate)
30 Funnel-shaped sheet guide portion (holddown element)
31 Sheet holddown portion (holddown element)
32 Pivot pin (holddown element)
33 Travel limiter stud (holddown element
40 Entraining element segment (entraining element)
41 Entraining element pin (entraining element)
42 Spring element (between entraining element and alignment roller)
43 Stop (on entraining element, for alignment roller)
50 Oblong travel limiting hole (on holder/for holddown element)
51 Oblong travel limiting hole (holder for basic/removal position)
60 Stepping motor/servomotor (drive unit)
61 Input drive shaft (drive unit)
62 Input drive belt pulley (drive unit)
63 Toothed belt (drive unit)
64 Output drive shaft (alignment means, radial cam)
65 Output drive belt pulley (alignment means, radial cam)
66 Bearing bushing/bearing means (holder/input drive shaft with freewheel
and catch)
67 Support (for motor)
68 Stop pin (for holder/on support)
70 Depositing surface (collecting tray)
71 Front delimiter (collecting tray)

What is claimed is:

1. Apparatus having alignment means for delivering, depositing, and aligning individual sheets in a collecting tray to form at least one sheet stack from sheets collected one on top of another, the collecting tray of which has a depositing surface with at least one front delimiter against which the sheets are aligned; and having a holddown element, resting on the sheet stack, said alignment means for aligning a topmost delivered sheet being drivable by a drive unit and said alignment means being movable together with the holddown element relative to the stack in the stacking direction, wherein said alignment means comprises a radial cam which is supported on the holddown element so that said alignment means can selectively be brought out of engagement with the topmost sheet of the stack during delivery of a sheet to the stack, and brought into engagement therewith in order to align the delivered sheet, wherein said alignment means have at least one alignment roller which is rotatable about the rotation axis thereof and has on the outer periphery a concentrically arranged D-shaped alignment segment with a friction surface applied on its outer periphery, and wherein said radial cam, configured as a cam plate with a cam lobe, is arranged on the rotation axis of the alignment roller, said holddown element is pivotable in the stacking direction and defines a sheet thread-in guide, and said radial cam is supported with its cam lobe remote from said holddown element when the alignment roller is in engagement with the topmost sheet.

2. Apparatus as defined in claim 1, wherein before the alignment means are brought into engagement with the topmost sheet delivered onto the stack, the alignment means can be brought by means of the drive unit up to an alignment speed in the sheet alignment direction which corresponds to the speed of the sheet in the delivery direction shortly before reaching the front delimiter of the collecting tray.

3. Apparatus as defined in claim 1, wherein shortly before the topmost delivered sheet reaches the front delimiter of the collecting tray and shortly before the topmost delivered sheet is released by delivery rollers, said alignment means of the apparatus can be brought by said radial cam into slip-free engagement with the topmost delivered sheet, and said alignment means can be brought out of engagement with the topmost delivered sheet when the topmost sheet has reached the front delimiter of the collecting tray.

4. Apparatus as defined in claim 1, wherein said at least one alignment roller of said alignment means and the radial cam are together driven by said drive unit rotating in the sheet alignment direction.

5. Apparatus as defined in one of claim 1, wherein said alignment roller, said radial cam, said holddown element, and the drive unit can together automatically be adjusted to a respective stack height of the sheet stack, the stack height being determined by a sheet counting device and/or a stack height measurement device.

6. Apparatus having alignment means for delivering, depositing, and aligning individual sheets in a collecting tray to form at least one sheet stack from sheets collected one on top of another, the collecting tray of which has a depositing surface with at least one front delimiter against which the sheets are aligned; and having a holddown element resting on the sheet stack, said alignment means for aligning a topmost delivered sheet being drivable by a drive unit and said alignment means being movable together with the holddown element in the stacking direction relative to the stack, wherein said alignment means and the holddown element can together be brought by a lifting device into a position spaced away from the topmost sheet of the stack for removal of a completed sheet stack from the collecting tray and, wherein said lifting device is defined by a rotation-direction-dependent bearing means and by said drive unit for the alignment means.

7. Apparatus as defined in claim 6, wherein in order to bring the holddown element and the alignment means, into the removal position, the drive unit can be operated in a drive direction opposite to the sheet delivery direction and sheet alignment direction.

8. Apparatus as defined in claim 7, wherein said alignment means includes an alignment roller, and wherein said alignment roller, said radial cam, and said holddown element are arranged on a common holder which is pivotably mounted at a first end by at least one bearing means configured as a bearing bushing on an input drive shaft of said drive unit; and said alignment roller and radial cam are arranged on a common output shaft, extending parallel to the input drive shaft, at a second end of the holder, the output drive shaft also being in operative engagement with the input drive shaft.

9. Apparatus as defined in claim 8, wherein when the input drive shaft is rotating in a direction in the sheet alignment direction, the bearing bushing and thus the holder run freely on the input drive shaft, and when the input drive shaft is rotating in the direction opposite to the sheet alignment direction and sheet delivery direction, the bearing bushing locks on the input drive shaft and thus pivots the holder upward against a stop in the removal position.

10. Apparatus as defined in claim 8 wherein the radial cam configured as a cam plate is rigidly joined to the output drive shaft, and the alignment roller is mounted so as to rotate freely on the output drive shaft and is connected by a spring element to at least one entraining element joined rigidly to the output drive shaft.

11. Apparatus as defined in claim 9, wherein the spring element is tuned in terms of its minimum spring force in such a way that during alignment of the topmost delivered sheet, the alignment roller can be entrained by the entraining element without significant extension of the spring element such that during alignment, a frictional force can be generated on the topmost delivered sheet by the friction surface of the alignment roller such that a sheet with a heavy weight and a low coefficient of friction can be reliably aligned against the front delimiter of the collecting tray, and the spring element is tuned in terms of its maximum spring force in such a way that a sheet with a light weight and/or low stiffness is not curled, creased, or lifted at the delimiter as it is aligned against the front delimiter.

12. Apparatus as defined in claim 8, wherein the holddown element is mounted at the second end of the holder in front of the output drive shaft with respect to the sheet delivery direction and can be pivoted against a travel limiter; and the holddown element has a funnel-shaped sheet guide portion in the region of its pivot pin and a sheet holddown portion in the region of the front delimiter of the collecting tray.

13. Apparatus as defined in one of claim 8, wherein the drive unit has a microprocessor-controlled stepping motor or servomotor;

the drive unit has a belt drive between the input drive shaft of the drive motor and the output drive shaft; and an output position of the alignment means radial cam, in which the alignment means are out of engagement with the topmost sheet of the stack, can be sensed and established by means of a sensor device.

* * * * *